United States Patent [19]

Tanaka

[11] Patent Number: 4,827,754

[45] Date of Patent: May 9, 1989

[54] SQUEEZING AND CHAMFERING DEVICE FOR TUBE END

[75] Inventor: Shigeyoshi Tanaka, Osaka, Japan

[73] Assignee: Kabushiki Kaisha Watanabe Kogyo, Saitama, Japan

[21] Appl. No.: 225,577

[22] Filed: Jul. 28, 1988

Related U.S. Application Data

[63] Continuation of Ser. No. 938,888, Dec. 8, 1986, abandoned.

[51] Int. Cl.[4] ..... B21D 41/04

[52] U.S. Cl. ..... 72/316; 72/318; 72/352; 72/367

[58] Field of Search ..... 72/316–318, 72/367, 369, 352, 361, 115, 117, 84; 10/87, 90; 29/157 R, 157.4

[56] References Cited

U.S. PATENT DOCUMENTS

| | | | |
|---|---|---|---|
| 602,940 | 4/1898 | Hall | 72/318 |
| 1,709,998 | 4/1929 | Mirfield | 72/352 |
| 2,100,939 | 11/1937 | Brenner | 72/318 |
| 3,394,572 | 7/1968 | Van Allman | 72/352 |
| 3,415,100 | 12/1968 | Britts | 72/317 |
| 3,820,375 | 6/1974 | Koski | 72/318 |
| 4,068,515 | 1/1978 | Kowal et al. | 72/318 |
| 4,383,429 | 5/1983 | Ceccacci | 72/318 |
| 4,493,201 | 1/1985 | Schmidt | 72/367 |

FOREIGN PATENT DOCUMENTS

| | | | |
|---|---|---|---|
| 2800079 | 7/1978 | Fed. Rep. of Germany | 72/317 |
| 585904 | 12/1977 | U.S.S.R. | 72/318 |
| 586954 | 1/1978 | U.S.S.R. | 72/318 |
| 928070 | 6/1963 | United Kingdom | 72/318 |
| 1207464 | 10/1970 | United Kingdom | 72/318 |

*Primary Examiner*—Daniel C. Crane

*Attorney, Agent, or Firm*—Stevens, Davis, Miller & Mosher

[57] ABSTRACT

In a squeezing and chamfering device comprising a cylindrical frame, a chuck device provided at an end of the cylindrical frame for seizing a tubular material, a driving device provided at the other end of the cylindrical frame with an output shaft thereof extended in the cylindrical frame, and a slide holder secured to an end of the output shaft to be slidable in the cylindrical frame in an axial direction thereof, a squeezing die having a tapered inner bore engageable with the tubular material is detachable secured to the slide holder, and a chamfering portion is provided at an end of the inner bore away from the chuck device.

3 Claims, 2 Drawing Sheets

SQUEEZING AND CHAMFERING DEVICE FOR TUBE END

This application is a continuation of application Ser. No. 938,888 filed Dec. 8, 1986 now abandoned.

BACKGROUND OF THE INVENTION

This invention relates to a squeezing and chamfering device to be used with a screw-thread roll-forming machine for producing a tapered screw-threaded portion at an end of a gas pipe or a joining section of the same.

Heretofore, an end of a gas pipe or a joining section thereof has been processed to form a tapered screw thread b on the outer surface of an opening end $a_1$ of a pipe as shown in FIG. 1. However, since the tapered screw-thread b is formed by use of a die, the thickness of the end portion $a_1$ becomes excessively thin, thereby causing deficiency in the strength of the end portion $a_1$. Furthermore, since the structure of the material of the pipe is cut-formed by the die, the strength of the threaded portion tends to be reduced.

Otherwise, the tapered screw-thread b has been formed on the end portion $a_1$ of the pipe a as shown in FIG. 2 by use of a tapered thread roll-forming machine. According to this method, since the thread b is formed by pressing a rolling die onto the surface of a tapered portion, the structure of the material of the pipe and hence the strength of the threaded portion of the pipe are not damaged. However, the roll-forming machine is ordinarily constructed so that the roll-forming operation is carried out only after a tapered portion c has been formed at an opening end a1 of the pipe and an end surface d of the tapered portion c has been chamfered.

Forming the tapered portion c and chamfering the end surface d, however, have been ordinarily effected separately, and therefore, the thread-forming operation of gas pipe has been found to be extremely troublesome, and saving of the labor cost due to a large-scale production has been thereby made difficult.

SUMMARY OF THE INVENTION

A primary object of the invention is to provide a squeezing and chamfering device for tube end wherein the above described difficulties of the conventional procedure can be substantially eliminated.

A more specific object of the invention is to provide a squeezing and chamfering device for the tube end, wherein before an end portion of the gas pipe is subjected to a roll-forming operation of the tapered screw-thread, formation of the tapered portion without accompanying surface hardening and chamfering of the end surface of the tapered portion are carried out simultaneously as a single step, thereby simplifying the process steps and enabling the execution of a labor-saving operation on the tube end.

These and other objects of the invention can be achieved by a squeezing and chamfering device for a tube end, the device comprising a cylindrical frame, a chuck device provided at an end of the cylindrical frame for seizing a tubular material to be processed, a driving device provided at the other end of the cylindrical frame with an output shaft thereof extended into the cylindrical frame, a slide holder secured to an end of the output shaft so as to be shifted therewith within the cylindrical frame in an axial direction of the same, a squeezing die detachably secured to the slide holder and having a tapered inner bore engageable with the tubular material seized by the chuck device, and a chamfering portion provided at an end of the inner bore away from the chuck device.

DESCRIPTION OF THE PREFERRED EMBODIMENT

Figure 4:
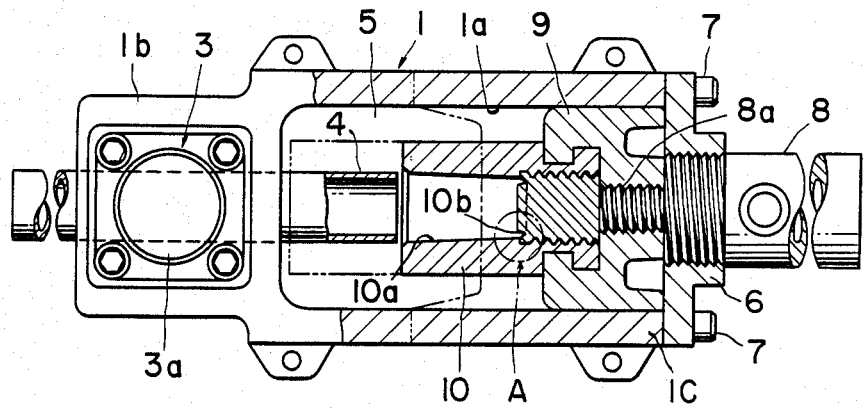
FIG. 4 is a plan view, partly fragmented, of the squeezing and chamfering device according to the present invention.
Figure 5:
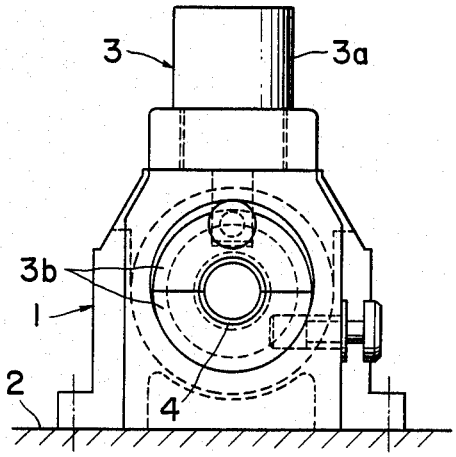
FIG. 5 is a profile view of the squeezing and chamfering device shown in FIG. 4.
Figure 6:
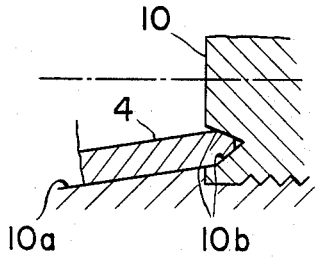
FIG. 6 is an enlarged cross-sectional view of a portion surrounded by a one-dot-dash line in FIG. 4.

A preferred embodiment of the present invention will now be described with reference to FIGS. 4, 5 and 6.

In these drawings, a cylindrical frame 1 is provided with a cylindrical portion la secured to a base plate 2, and a chuck 3 for clamping a tube 4 to be processed is provided at one end 1*b* of the cylindrical portion 1*a*. The chuck 3 may include a chuck portion 3*b* divided into two parts secured to an output shaft 2 of a hydraulic cylinder device 3*a*. The tube 4 to be processed inserted in the chuck portion 3*b* is temporarily seized and held in its position under the action of the device 3*a*. At a middle portion of the cylindrical frame 1 is provided a window 5 through which an end of the tube 4 clamped by the chuck portion 3*b* can be observed. A bracket 6 is secured to the other end 1*c* of the cylindrical frame 1 by means of bolts 7. A cylinder device 8 for attaining the press-operation is mounted on the bracket 6 so as to extend along the central axis of the cylindrical frame 1. A slide holder 9 which is slidably movable along the internal surface of the cylinder portion 1*a* is secured to an end of the output shaft 8*a* of the cylinder device 8 extending into the cylindrical portion 1*a*. A squeezing die 10 is detachably secured to the slide holder 9 so that the die 10 is held in opposition to an opening end of the tube 4. A tapered internal bore 10*a* is formed through the die 10, and a chamfering portion 10*b* is provided at an end of the internal bore 10*a* as best illustrated in FIG. 6. Although in FIG. 4, the chamfering portion 10*b* is indicated to be formed into a separate member, it may otherwise be formed integrally with the die 10. When the chamfering portion 10*b* is formed separately, it is advantageous to secure the portion 10*b* to the die 10 in the form of a screw engagement.

Figure 1:
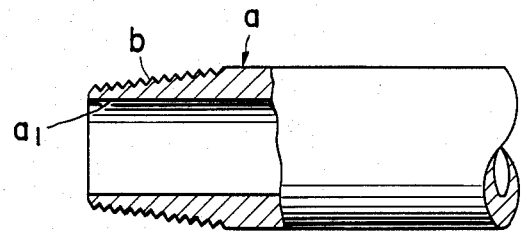
FIG. 1 is a side view, partly cut-away, of a conventionally formed gas pipe with a tapered screw thread formed at an end thereof.
Figure 2:
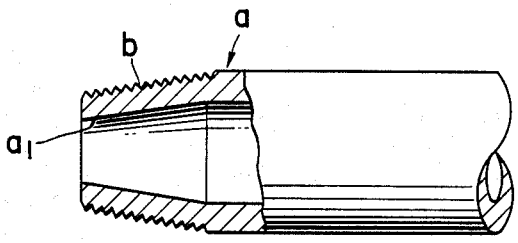
FIG. 2 is a view similar to FIG. 1 showing another conventional gas pipe, an end of which is squeezed and roll-formed with a tapered screw thread.
Figure 3:
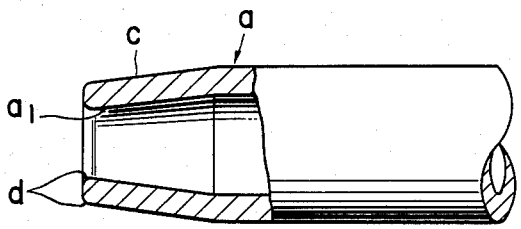
FIG. 3 is a view similar to FIGS. 1 and 2 showing a gas pipe, an end of which is squeezed and chamfered by a device according to the present invention.

At the time of the operation, the tube 4 to be processed is fixed in a chuck portion 3*b* of the chuck, and the cylinder device 8 is operated. The squeezing die 10 detachably secured to the slide holder 9 is moved leftward as viewed in FIG. 4 thereby pressing the end of the tube 4 radially inwardly by a pressing force ranging from 6 to 9 tons. At the end of the squeezing operation, the surface at the tip of the end portion of the tube 4 is chamfered by the chamfering portion (or member) 10*b*, thereby providing a configuration of the tube end as shown in FIG. 3 through a single step of operation. Furthermore, during the sliding movement of the squeezing die 10 relative to the tube 4, any deviation caused between the center lines of the die 10 and the tube 4 can be eliminated automatically.

As described above, according to this invention, a chuck device 3 is provided at an end 1*b* of a cylindrical frame 1, while a pressing cylinder device 8 is provided at the other end 1*c* of the frame 1, a slide holder 9 being secured to an output shaft 8*a* of the cylinder device 8 to be slidable relative to the internal surface of the cylindrical frame 1, a squeezing die 10 being detachably coupled with the slide holder 9 such that the die 10 is held in opposition to the tube 4 seized by the chuck device 3, and a tapered internal bore 10*a* and a chamfering portion 10*b* formed at an end of the internal bore 10*a* are provided in the squeezing die 10. As a consequence, not only a tapered portion of the tube 4 and a chamfered end surface of the tapered portion can be formed simultaneously in one step, but also the device can be formed into a portable type of a simple construction operable by an electric motor of approximately 1 KW and therefore adapted to a field use of pipe laying without requiring any other special tools, while the squeezing die and the chamfering portion can be changed freely when it is required.

What is claimed is:

1. A squeezing and chamfering device for a tube end, comprising:

a cylindrical frame;

a chuck device provided at one end of said cylindrical frame for seizing a tubular material to be processed;

a driving device provided at the other end of said cylindrical frame with an output shaft thereof extended into said cylindrical frame;

a slide holder secured to an end of said output shaft so as to be slidably movable within said cylindrical frame in an axial direction of the same;

a squeezing die detachably secured to said slide holder and having a tapered inner bore which in section is defined by straight lines converging toward each other and toward a bottom of said die, said inner bore being engageable with an end portion of said tubular material seized by said chuck device and operating to squeeze the exterior of said end portion of said seized tubular material to for said end portion into an inwardly directed tapered portion, the external diameter of said taper portion at all locations there-along being less than that of said tubular material at locations other than at said taper portion; and a chamfering portion provided at an end of said inner bore away from said chuck device at the bottom of said die and operating to provide a chamfer at an end of said tapered portion, said chamfering portion being provided by a groove of V-shaped section, said V-shaped groove being located at the bottom of said die in a position where one of two walls which establishes the V-shaped groove intersects with the tapered inner bore and the other wall of said V-shaped groove intersects with the one wall such that said V-shaped groove produces a chamfer having a bevel on the interior and exterior of said tubular material at its end.

2. The squeezing and chamfering device according to claim 5 wherein any deviation between center lines of said squeezing die and said tubular material seized by said chuck device is eliminated during a sliding movement of said squeezing die.

3. The squeezing and chamfering device according to claim 5 wherein said chamfering portion is made into a separate member detachable from said squeezing die.

* * * * *